United States Patent [19]

Mizuno

[11] 3,940,552

[45] Feb. 24, 1976

[54] WATER-COOLED PANEL FOR ARC FURNACE

[75] Inventor: Susumu Mizuno, Nagoya, Japan

[73] Assignee: Daido Seiko Kabushiki Kaisha, Japan

[22] Filed: Jan. 17, 1975

[21] Appl. No.: 541,925

[30] Foreign Application Priority Data

Jan. 23, 1974 Japan ..... 49-10713[U]

[52] U.S. Cl. ..... 13/35; 13/32

[51] Int. Cl.[2] ..... F27D 1/04

[58] Field of Search ..... 13/32, 35

[56] References Cited

UNITED STATES PATENTS

| | | | |
|---|---|---|---|
| 3,777,043 | 12/1973 | O'Neill | 13/35 X |
| 3,804,969 | 4/1974 | Treilhard | 13/35 |
| 3,829,595 | 8/1974 | Nanjyo et al. | 13/35 X |
| 3,832,478 | 8/1974 | Books | 13/35 |

FOREIGN PATENTS OR APPLICATIONS

| | | | |
|---|---|---|---|
| 253,492 | 8/1963 | Australia | 13/35 |

*Primary Examiner*—R. N. Envall, Jr.
*Attorney, Agent, or Firm*—Bucknam and Archer

[57] ABSTRACT

A water-cooled panel as provided in an arc furnace so as to form a portion of the furnace wall has an outer surface exposed to the inside of the arc furnace. The exposed surface is provided with a plurality of fins.

2 Claims, 4 Drawing Figures

WATER-COOLED PANEL FOR ARC FURNACE

BACKGROUND OF THE INVENTION

1. Field of the Invention

This invention relates to an improvement in water-cooled panels for use in arc furnaces, particularly for steel making to avoid the production of hot-spots.

2. Description of the Prior Art

Recently, in arc furnaces, particularly large arc furnaces for use in steel works, it has been proposed that an electric power 1.5 to 2 or more times as much is fed to the furnaces for the purpose of facilitating temperature raising operation after melting so as to effectively shorten refining time as well as for the purpose of shortening melting time so as to increase productivity. However, it has been found that the supply of such a large electric power to the arc furnaces leads to an increase in the number of melting-lost portions as produced due to arc heat in a local area of the furnace wall close to its electrode and called "hot-spot."

Among measures therefor it has been proposed to provide an arc furnace with a water-cooled panel having a smooth surface at an area of the furnace wall which is so close to its electrode that hot-spots intend to be produced therein, whereby the furnace wall is prevented from being locally melted and lost. In this proposed arrangement, since the water-cooled panel is located behind the furnace wall made of refractory material such as refractory bricks, some of the refractory bricks covering the box have intended to be subject to hot-spot and be melted and lost. In addition to this, since the refractory bricks covering the panel is heated at its outer surface by arc heat and is cooled at its inner surface by the cooling effect of the panel, there have occurred distortions due to the difference between thermal expansions at the outer and inner surfaces, resulting in "spalling" to the extent that the outer surface of the panel is exposed to the inside of the furnace. Therefore, since the outer exposed surface of the panel is subject directly to arc heat, it has been necessary to increase the flow of water coolant circulating through the panel in order to prevent overheating of the panel surface. As a result, the thermal efficiency of the furnace has been lowered. Although slugs have been scattered to and deposited on the exposed surface of the water-cooled panel to form a layer of deposited slug which would play the same role as that of the covering refractory bricks mentioned above, the layer of deposited slug has been so thin and fragile as to peel off very often, thereby resulting in a lowering of thermal efficiency of the furnace.

The main object of this invention is to provide an improved water-cooled panel for arc furnaces which eliminates the above described disadvantages of the prior art and requires a smaller flow of water coolant circulating therethrough, whereby the thermal efficiency of the furnace can be increased.

SUMMARY OF THE INVENTION

According to this invention, a water-cooled panel as provided in an arc furnace so as to form a portion of the furnace wall has an outer surface exposed to the inside of the arc furnace, said exposed surface being provided with a plurality of fins so that a thicker layer of slug can be deposited on and more strongly sticks to the exposed surface.

DESCRIPTION OF THE PREFERRED EMBODIMENTS

Figure 1:
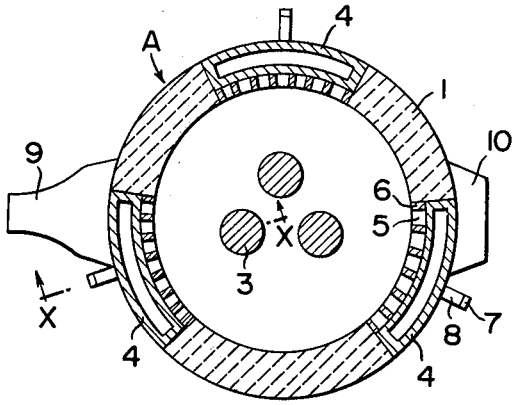
FIG. 1 is a cross section showing the furnace wall of a three-phase arc furnace having water-cooled panels as an example of this invention.
Figure 2:
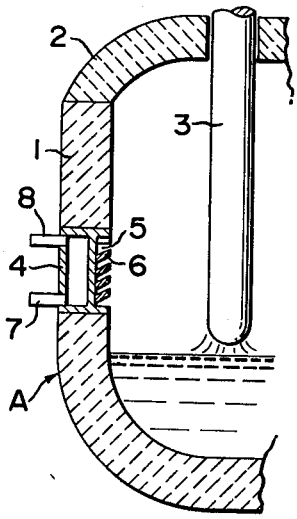
FIG. 2 is a sectional view as taken along a line X—X of FIG. 1.

Referring now to FIGS. 1 and 2, there is illustrated a three-phase arc furnace A comprising a furnace wall 1 made of refractory material such as refractory bricks, a furnace cover 2 and electrodes 3. The furnace wall 1 is provided with water-cooled panels 4 at the closest areas thereof to the respective electrodes 3, said water-cooled panels being made of a desired steel sheets.

Figure 3:
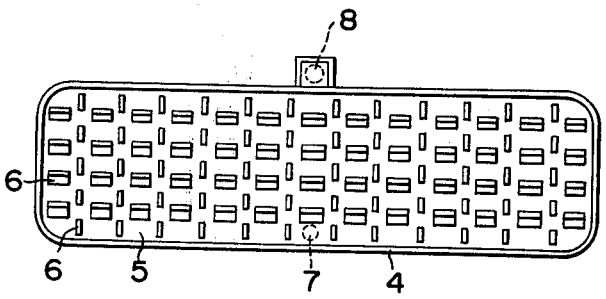
FIG. 3 is an enlarged front view of one of the water-cooled panels of FIGS. 1 and 2.
Figure 4:
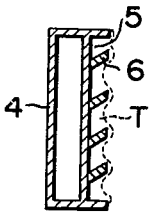
FIG. 4 is a longitudinally sectional view of a water-cooled panel of this invention showing a layer of slug deposited on the surface of the panel as exposed to the inside of a furnace.

The upper ends of the water-cooled panels abut on the furnace wall 1 and the panels are latched thereby. One side surface of the water-cooled panel 4 is exposed to the inside of the furnace A to form a portion of the furnace wall. As best shown in FIGS. 3 and 4, the exposed side surface 5 is provided with a plurality of projecting fins 6 in grid or checkerboard pattern which fins have a desired size and are upwardly inclined. The water-cooled panels 4 are provided with a water coolant inlet 7 and a water coolant outlet 8. Reference numeral 9 indicates an outlet for molten steel and reference numeral 10 an outlet for sludge in the embodiment of FIG. 3, the fins in the rows of odd number are in the shape of a bar having a rectangular cross section, horizontally oriented and inclined upwardly, while in the rows of even number they are in the shape of a bar having the same rectangular cross section but they are vertically oriented.

In operation, water coolant circulates constantly through the panel 4 from the inlet 7 to the outlet 8, thereby effecting water cooling of the exposed surface 5. Some of fluid slugs as scattered due to arcing will be deposited on the exposed surface 5 and strongly stick thereto due to the above-mentioned cooling effect to form a layer T of refractory material wherein the fins 6 serve as cores thereof, as shown in dotted line in FIG. 4. Thus the refractory layer T of slug formed on the surface 5 of the panel 4 is strong enough to permanently work as a portion of the furnace wall.

Water-cooled panels constructed and mounted on a 70t arc furnace according to this invention have been tested for the thickness and strength of the refractory layers T of slug deposited on the exposed surfaces of the panels. The results will now be described in comparison with conventional water-cooled panels.

The thicknesses of the refractory layers T of slug in the panels of this invention were 15 to 20 mm, while in conventional panels they were 5 to 10 mm. The strength of the refractory layers T deposited in the panels of this invention was such that they cannot be peeled off without being considerably strongly scratched by means of a steel bar, while in conventional panels they could easily be peeled off by only being tapped. For a same flow of water coolant, the temperature rise of water coolant in the boxes of this invention was 3° to 5°C, while in conventional panels it was 8° to 10°C.

The thickness of the refractory layer grown on the exposed surface of the water-cooled panel depends on the thermal balance between the cooling effect in the box and the arc heat produced in the arc furnace. In the panel of this invention, since the exposed surface 5 is provided with the fins 6, the slug layer T grows thicker and more strongly sticks to the exposed surface 5 as compared with conventional panels having a smooth exposed surface without any fins. Therefore, in the water-cooled panel 4 of this invention having such thicker and more strongly sticked refractory layer T, the temperature rise of water coolant can be maintained very low. Thus the flow rate of water coolant circulating through the water-cooled panel can be reduced and the thermal efficiency of the arc furnace itself can be increased.

Furthermore, since the layer of deposited slug as mentioned above serves as a thermally and electrically insulating layer, this invention has the advantage that the inwardly exposed wall of the water-cooled panel can be prevented from being damaged due to cuttings by oxygen lance carried out as a measure for removing the steel scraps deposited on the wall or due to sparkings produced between the panel and steel scraps in melting operation of steel scraps. Thus the water-cooled panel of this invention itself is more stable and has a longer life.

Although an embodiment of this invention has been illustrated and described with fin members being welded to the exposed surface of the panel, the fin members may be formed integrally with the inwardly exposed wall of the panel by press, molding, etc., other than welding. Although in the illustrated embodiment of this invention the fins 6 are in the form of a strip, and upwardly inclined and arranged in grid or checkerboard pattern, further, it is obvious that the panels of this invention can be given a variety of constructions, not being limited to the aforesaid specific examples. For example, the fins may be trapezoidal or fan shaped in section. The fins may be perpendicular to the inwardly exposed wall surface of the panel. Furthermore, the fins may be in the form of bars and arranged at random over the inwardly exposed wall surface of the panel to present the appearance of a forest.

I claim:

1. A water-cooled panel of an arc furnace so as to form a portion of the furnace wall, characterized in that the panel has an outer surface exposed to the inside of the arc furnace, said exposed surface being provided with a plurality of fins, said fins being welded to said exposed surface and being upwardly inclined and arranged in grid or checkerboard pattern.

2. A water-cooled panel of an arc furnace so as to form a portion of the furnace wall, characterized in that the panel has an outer surface exposed to the inside of the arc furnace, said exposed surface being provided with a plurality of fins, wherein said fins are formed integrally with the exposed surface wall by press, molding, etc., other than welding and are upwardly inclined and arranged in grid or checkerboard pattern.

* * * * *